US008684017B2

(12) United States Patent
Glatz et al.

(10) Patent No.: US 8,684,017 B2
(45) Date of Patent: Apr. 1, 2014

(54) STANDING PARASOL

(75) Inventors: Gustav Adolf Glatz, Frauenfeld (CH); Claudio Roberto, Kirchberg (CH)

(73) Assignee: Glatz AG (CH)

( * ) Notice: Subject to any disclaimer, the term of this patent is extended or adjusted under 35 U.S.C. 154(b) by 300 days.

(21) Appl. No.: 13/161,708

(22) Filed: Jun. 16, 2011

(65) Prior Publication Data

US 2011/0315179 A1 Dec. 29, 2011

(30) Foreign Application Priority Data

Jun. 17, 2010 (EP) ..... 10166397

(51) Int. Cl.
*A45B 25/14* (2006.01)
*A45B 19/04* (2006.01)

(52) U.S. Cl.
USPC ..... 135/20.3; 135/25.4

(58) Field of Classification Search
USPC ..... 135/15.1, 20.3, 25.1, 25.4
See application file for complete search history.

(56) References Cited

U.S. PATENT DOCUMENTS 3,282,275 A * 11/1966 Pearlstine ..... 135/20.3
4,424,824 A 1/1984 Becher
5,785,069 A * 7/1998 Glatz ..... 135/20.1
6,058,951 A * 5/2000 Wilson ..... 135/20.3
8,272,391 B2 * 9/2012 Luo ..... 135/20.1

FOREIGN PATENT DOCUMENTS

CH 543 253 A 12/1973
DE 2 353 967 A 5/1974
NL 1031122 10/2007

* cited by examiner

*Primary Examiner* — David R Dunn
*Assistant Examiner* — Danielle Jackson
(74) *Attorney, Agent, or Firm* — George Pappas

(57) ABSTRACT

So that a drive (38, 50, 52) can be formed in the case of a standing parasol (2) having a mast (12) and a collapsible parasol canopy with canopy and support struts (4, 6), in which the canopy struts (4) and the support struts (6) are respectively connected to an upper or a lower articulation ring (8, 10), and in which the upper articulation ring (8) is connected to a telescopic tube (22) which is guided in the mast (12) and can be raised and lowered and the telescopic tube (22) for raising and lowering is connected to a circulating member (34), it is proposed that the circulating member (34) may be actuated by way of an upper deflection roller (36) and a drive gear (50) that is arranged on the mast (12), and that the upper deflection roller (36) is arranged on a deflection support by means of a deflection roller bearing (28), the deflection support being secured to the mast and projecting into the telescopic tube (22).

10 Claims, 7 Drawing Sheets

I - I

H - H

STANDING PARASOL

This application claims priority of European application EP10166397 having a priority date of Jun. 17, 2010, the disclosure of which is incorporated herein by reference.

TECHNICAL FIELD

The invention relates to a standing parasol.

BACKGROUND OF THE INVENTION

Drives for parasols having an upper mast part which may be raised and lowered telescopically are known for example from DE 2 353 967 A. There it is proposed that the telescopic part be driven by means of an upper articulation ring by way of a circulating toothed belt. According to DE 2 353 967 A, the toothed belt is to emerge through an opening in the mast at the drive gear and be attached to the telescopic part again at the upper circulating gear. The disadvantage here is that the toothed belt, which is open, can easily be damaged where it is outside the mast. Furthermore, the fact that it could not satisfy aesthetic demands has proved to be a drawback. In addition, the apertures in the mast wall have the effect of making the mast as a whole substantially less strong.

U.S. Pat. No. 4,424,824 A proposes, instead of a circulating member for actuating the telescopic part, using an angled gear for a spindle with a spindle nut in the telescopic part. Admittedly, this does replace the toothed belt and the aperture in the mast for the drive crank is small enough for the loss of strength in the mast no longer to be important; however, the solution proposed in U.S. Pat. No. 4,424,824 A is very disadvantageous in another respect, namely that an angled gear is required, and the crank has to be turned many times to achieve the required stroke length to open and close the parasol.

SUMMARY OF THE INVENTION

It is the object of the invention to propose a drive which allows the parasol to be opened and closed with few turns of the crank and which is protected by being located in the interior of the mast.

The object of the invention is achieved by a standing parasol having a mast and a collapsible parasol canopy with canopy and support struts and having a lower articulation ring and a upper articulation ring, in which the canopy struts and the support struts are respectively connected to a lower articulation ring or an upper articulation ring, in which the upper articulation ring is connected to a telescopic tube which is guided in the mast and can be raised and lowered, and in which the telescopic tube for raising and lowering is connected to a circulating member which may be actuated by way of an upper deflection roller and a drive gear that is arranged on the mast, wherein the upper deflection roller is arranged on a deflection support by means of a deflection roller bearing, wherein the deflection support being secured to the mast and projecting into the telescopic tube, wherein the deflection support being arranged in the mast by means of a drive casing and being connected to the mast and wherein the circulating member having a toothed belt or a chain of links, balls or beads.

Here the measures of the invention have the result that in the standing parasol according to the invention an aperture in the mast—other than at the hand crank, where an aperture is not a drawback—can be avoided, but that despite this a hand crank drives circulation and so enables an advantageously geared raising and lowering of the telescope with little exertion of force.

According to the invention, the deflection support is connected to the mast by means of a drive casing. For assembly and, where appropriate, inspection, it is advantageous if the deflection roller bearing takes the form of a centring guide in the telescopic tube. Also advantageous is a support web on which the deflection support is supported.

The invention makes it possible for the standing parasol to be constructed most particularly advantageously in that the deflection support contains a tensioning device for the circulating member, preferably in the form of a wedge-shaped rest surface and actuable from outside the mast by way of a tensioning screw.

The circulating member may include a toothed belt or a chain of links, balls or beads.

A preferred embodiment of the standing parasol includes a connecting member, preferably a cable, which is guided from the telescopic part by way of a deflection roller to the lower articulation ring, which is vertically adjustable.

It is advantageous if the circulating member includes a branch which is guided over a deflection roller to the lower articulation ring.

In a specific embodiment of the invention, the lower articulation ring is non-relocatably connected to the mast.

It is particular advantageous, if the drive casing, the drive roll, the circulating member, a toothed plate configured as circulating member attachment, telescopic guides, the deflection support, the deflection roller bearing, the deflection roller and the telescopic tube constitute a distinct construction group, which can be introduced into the mast and can be attached to the mast by means of the drive casing.

The elements which have been mentioned above, and the elements which are claimed and described in the exemplary embodiments below and are to be used according to the invention, are not subject to any particular exceptional conditions as regards their size, shape, materials used or engineering design, with the result that the selection criteria which are known in the respective field of application can be used without restriction.

BRIEF DESCRIPTION OF THE DRAWINGS

Further details, advantages and features of the subject matter of the present invention will be apparent from the description which follows of the associated drawings, in which—by way of example—standing parasols according to the invention are explained. In the drawings.

DETAILED DESCRIPTION OF THE PREFERRED EMBODIMENTS

Figure 1:
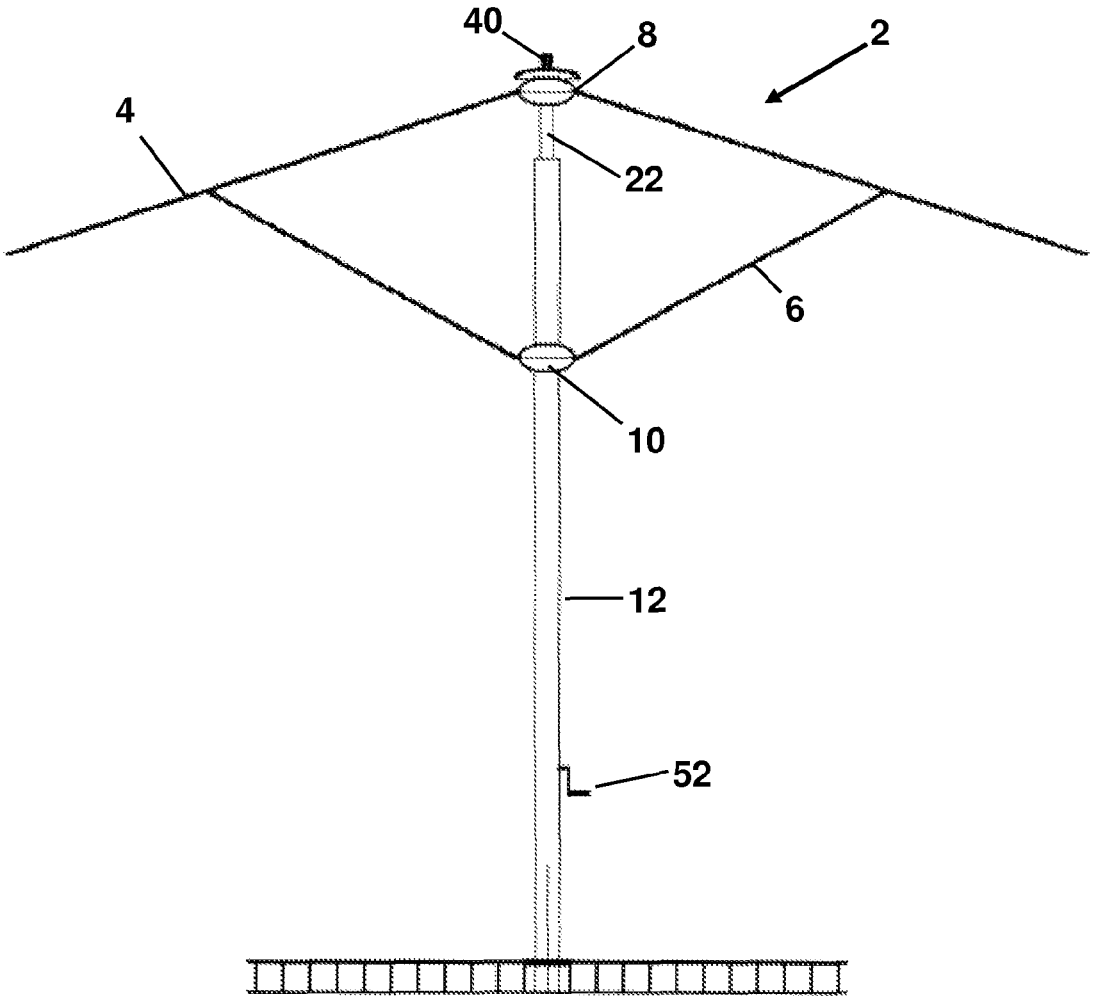
FIG. 1 shows a standing parasol according to an exemplary embodiment of the present invention, in an overall view.

For the sake of simplicity, the parasol designated as a whole as 2 in FIG. 1, having the standing mast 12, is illustrated as having only two mutually opposing canopy struts 4 and support struts 6, articulated to the upper articulation ring 8 and the lower articulation ring 10. In the construction of the invention, the number of struts depends on the size and the shape of the parasol, and may be from 6 to more than 16. The drive unit is located in the standing mast 12 and may be actuated by the hand crank 52 in order to open or close the standing parasol by raising or lowering the telescopic tube 22. At the top, the telescopic tube is closed off by means of a telescopic tube plug 40.

Figure 2:
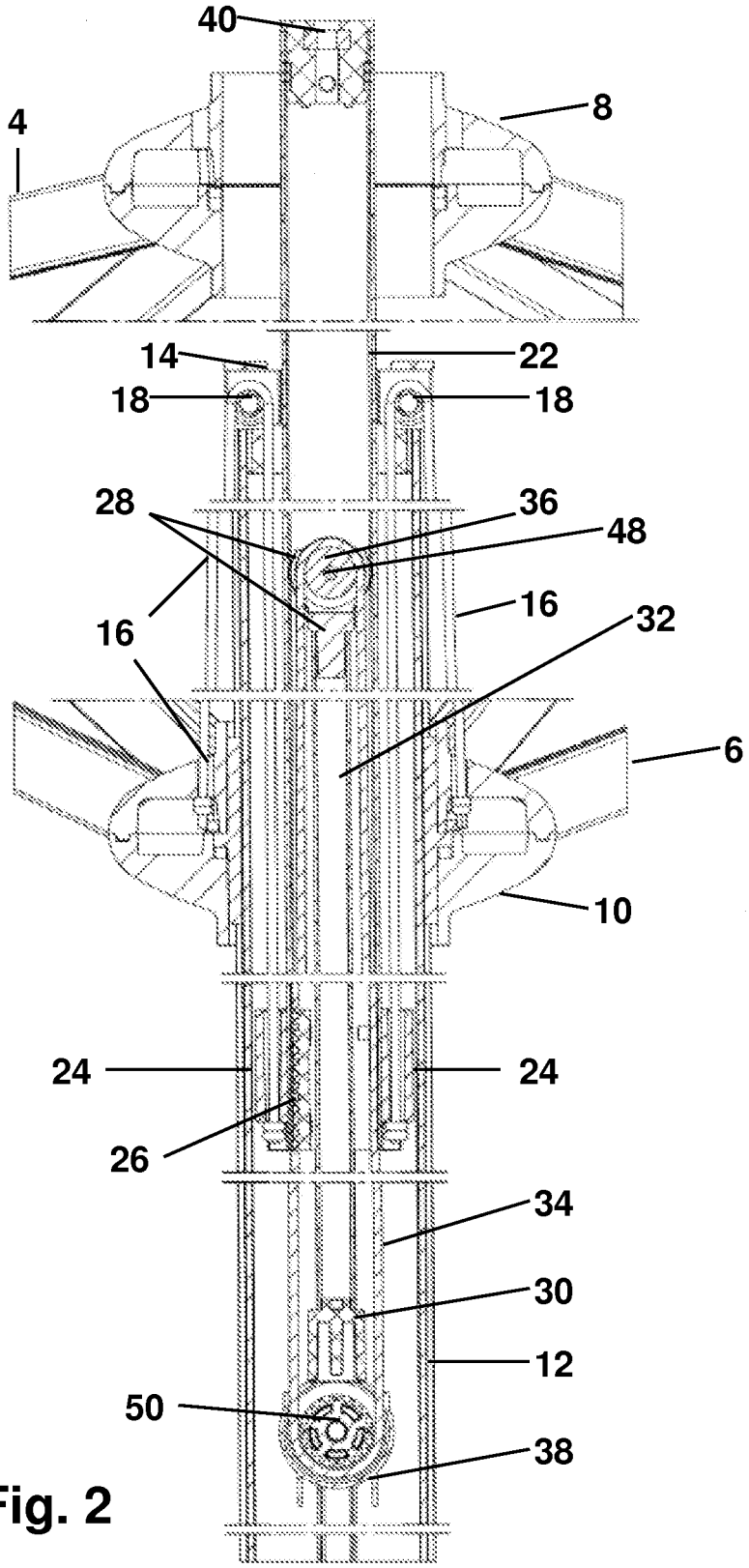
FIG. 2 shows a longitudinal section through the mast and the drive elements for the standing parasol according to FIG. 1.
Figure 3:
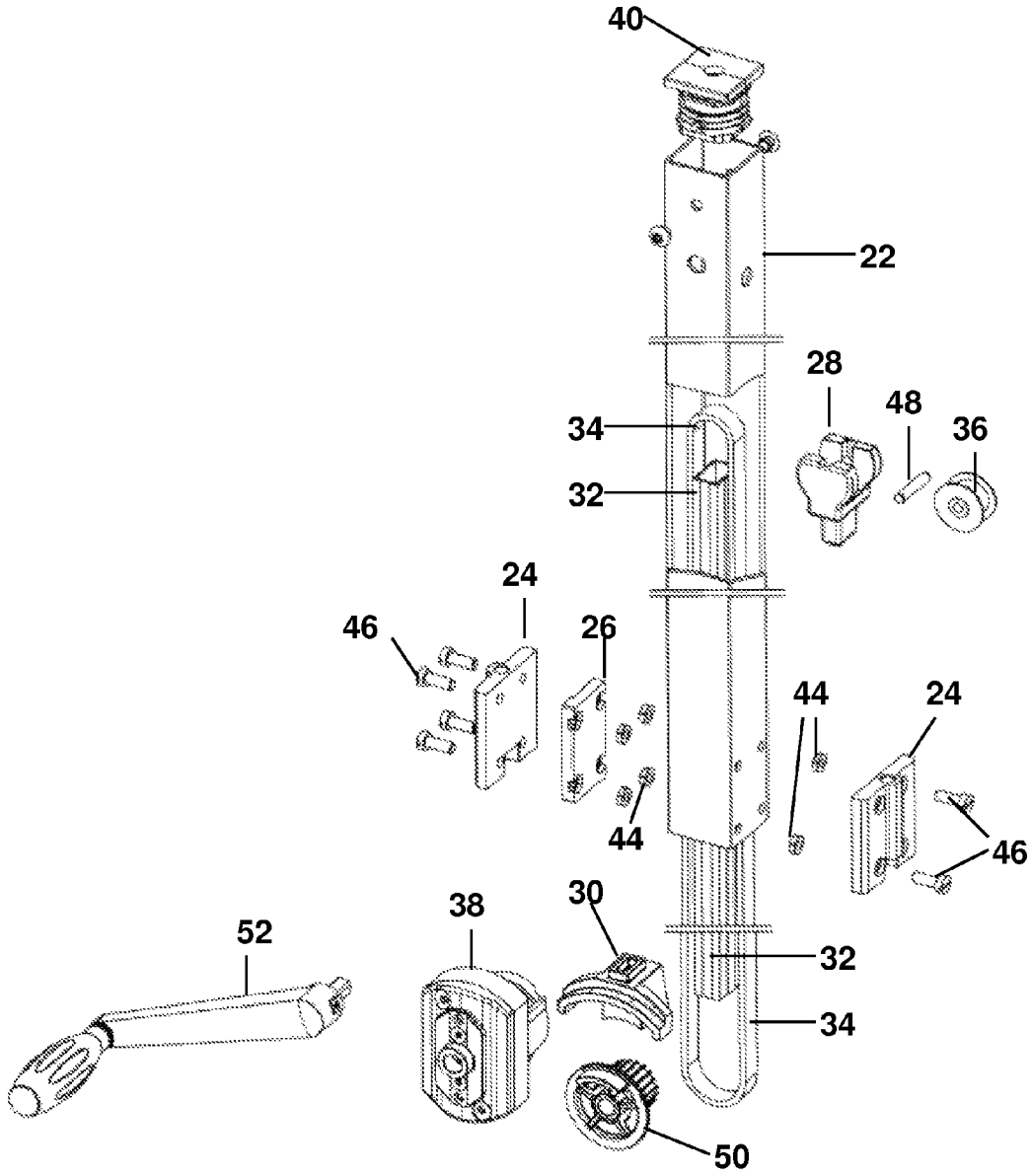
FIG. 3 shows an exploded illustration of the telescopic tube, with the functional elements, for the standing parasol according to FIG. 1.
Figure 4:
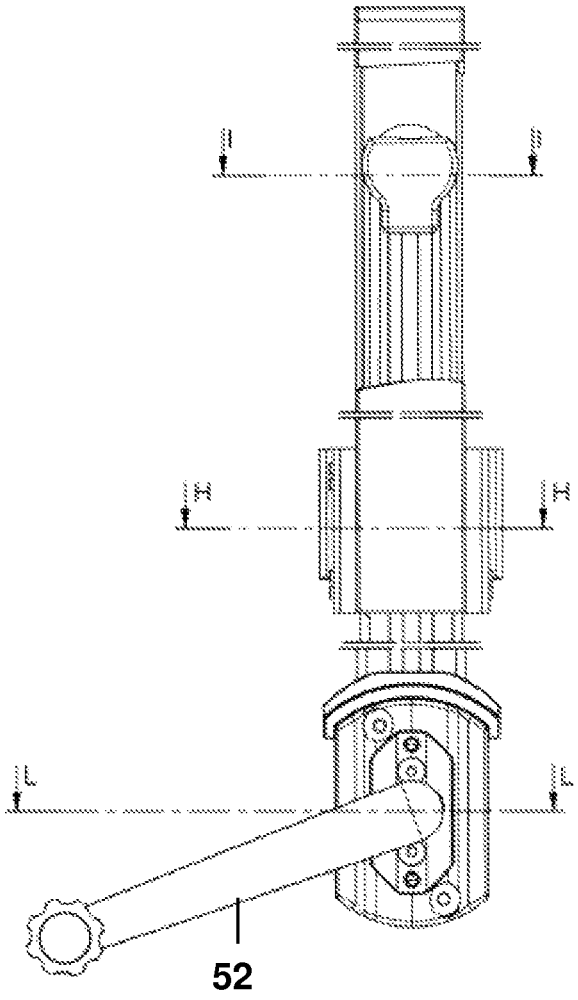
FIG. 4 shows a situational illustration to explain the sections I-I, H-H and L-L according to the exemplary embodiment of FIG. 2.
Figure 5:
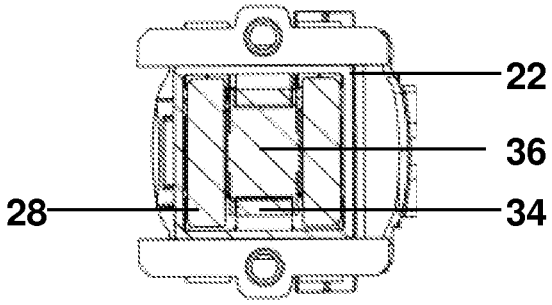
FIG. 5 shows a cross-sectional illustration along the line I-I at the height of the toothed belt deflection roller, according to FIG. 4.
Figure 6:
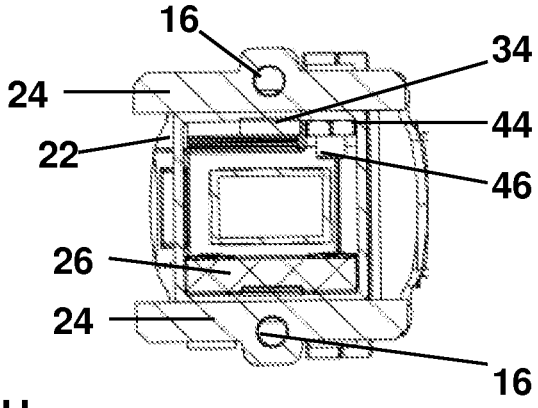
FIG. 6 shows a cross-sectional illustration along the line H-H at the height of the toothed plate, according to FIG. 4.
Figure 7:
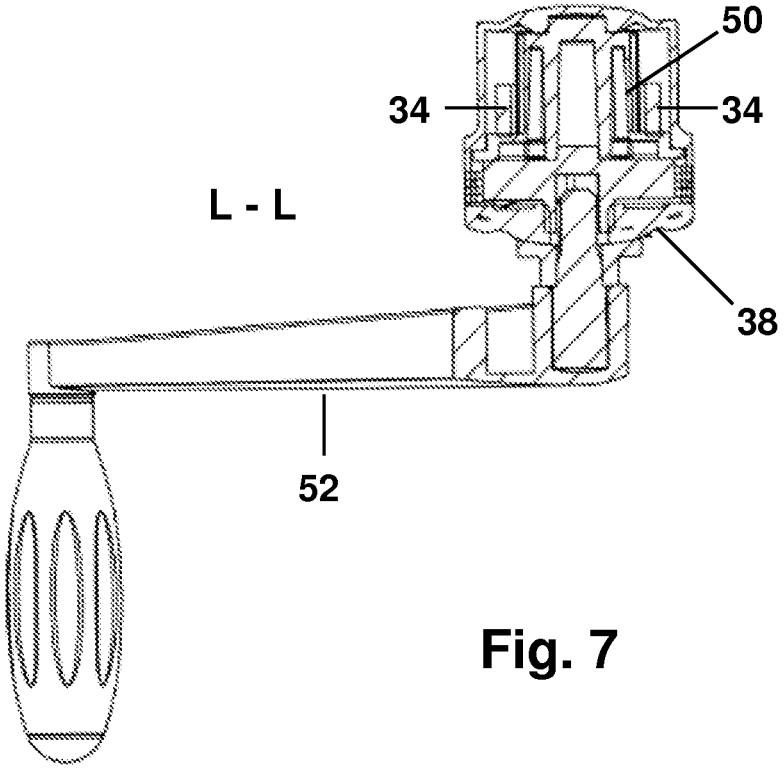
FIG. 7 shows a cross-sectional illustration along the line L-L through the drive gear, according to FIG. 4.

FIG. 2 shows a longitudinal section through the standing mast 12 and the drive elements. The drive gear 50 actuated by the hand crank 52 is anchored in the standing mast 12 by means of the drive casing 38. The support web 30 serves as a rest surface for the support profile 32, and the latter, together with the deflection roller bearing 28 and a toothed belt deflection roller 36 that rotates on a toothed belt deflection axis 48, provides for the required tension of the toothed belt 34. The external shape of the deflection roller bearing 28 also serves as a guide for the telescopic part, as a result of which the toothed belt 34 remains centred in the telescopic tube 22. As a result of the toothed plate 26 and the telescopic guide 24, on the one hand the ends of the toothed belt 34 are held together, and on the other they are connected to the telescopic tube 22 by means of the guide plate screws 46 and nuts 44.

To improve the geometry of the canopy and support struts 4, 6, in the exemplary embodiment illustrated the lower articulation ring 10 takes the form of a slide which moves in opposition to the upper articulation ring 8. The slide cable 16 is guided from the displaceable lower articulation ring 10 over the slide cable deflection roller 18, which rotates on the slide cable deflection axis, to the slide cable securing point 24. The slide cable may be connected on one side, on mutually opposing sides, or at multiple points. The mast guide 14 and the telescopic guide 24 serve to ensure that the telescopic tube 22 has good sliding properties.

In the exemplary embodiment illustrated here, the drive gear 50 is connected with a locking device such as a latch or wrap spring brake.

As an alternative, the support strut is connected to the upper articulation ring and the canopy strut is connected to the lower articulation ring to form a funnel-shaped parasol.

Figure 8:
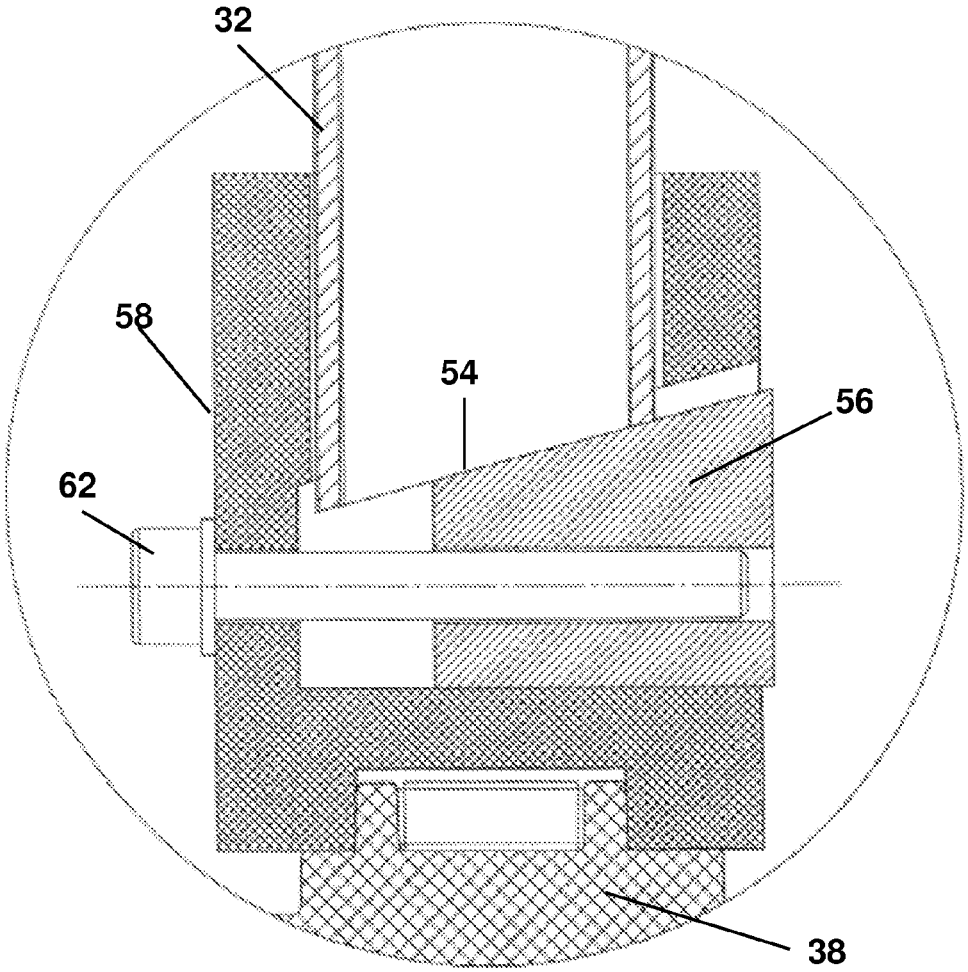
FIG. 8 shows a tensioning device for the circulating member.

The parasol drive according to the exemplary embodiment illustrated in FIG. 8 is provided with a tensioning device for the circulating member. The parasol drive according to the exemplary embodiment of FIG. 8 allows the fully assembled parasol to be actuated. The support profile 32 ends in a wedge-shaped surface 54 which fills the support profile 32. When the tensioning wedge 56 is displaced by means of the tensioning or adjustment screw 62, the support profile is raised or lowered and consequently the tension of the toothed belt 34 is regulated. The support profile 32 and the tensioning wedge 56 are guided in displacement in the tensioning casing 58. The tensioning casing 58 is supported on the drive casing 38 or anchored to the standing mast 12 separately. The tensioning or adjustment screw 62 is actuated through an aperture in the standing mast 12 using a conventional tool, to be precise a screwdriver.

LIST OF REFERENCE NUMERALS

2 Standing parasol
4 Canopy struts
6 Support struts
8 Upper articulation ring
10 Lower articulation ring
12 Mast, standing mast
14 Mast guide
16 Slide cable
18 Slide cable deflection roller
22 Telescopic tube
24 Telescopic guide and slide cable securing point
26 Toothed plate
28 Deflection roller bearing and centring guide
30 Support web
32 Deflection support, support profile
34 Toothed belt
36 Toothed belt deflection roller
38 Drive casing
40 Telescopic tube plug
44 Nuts for guide plate screws
46 Guide plate screws
48 Toothed belt deflection axis
50 Drive gear
52 Drive crank/hand crank
54 Wedge-shaped surface of the deflection support
56 Tensioning wedge
56 Tensioning casing
62 Tensioning screw, adjustment screw

The invention claimed is:

1. A standing parasol comprising a mast and a collapsible parasol canopy, canopy struts and support struts and lower articulation ring and a upper articulation ring, wherein the canopy struts and the support struts are respectively connected to the lower articulation ring or the upper articulation ring, wherein the upper articulation ring is connected to a telescopic tube which is guided in the mast and can be raised and lowered, and wherein the telescopic tube for raising and lowering is connected to a circulating member which may be actuated by way of an upper deflection roller and a drive gear that is arranged in the mast, wherein the upper deflection roller is arranged on a deflection support by means of a deflection roller bearing, the deflection support being secured to the mast and projecting into the telescopic tube, wherein the deflection support being arranged in the mast by means of a drive casing and being connected to the mast and wherein the circulating member having a toothed belt or a chain of links, balls or beads.

2. The standing parasol according to claim 1, wherein the deflection roller bearing takes the form of a centring guide in the telescopic tube.

3. The standing parasol according to claim 1, wherein the standing parasol further comprises a support web which supports the lower part of the deflection support.

4. The standing parasol according to claim 1, wherein the deflection support contains a tensioning device for the circulating member.

5. The standing parasol according to claim 4, wherein the tensioning device is in the form of a wedge-shaped rest surface.

6. The standing parasol according to claim 5, wherein the tensioning device is actuable from outside the mast by way of a tensioning screw.

7. The standing parasol according to claim 4, wherein the tensioning device is actuable from outside the mast by way of a tensioning screw.

8. The standing parasol according to claim 1, wherein the standing parasol further comprises a connecting member, preferably cable, which is guided from the telescopic tube by way of a deflection roller to the lower articulation ring, which is vertically adjustable.

9. The standing parasol according to claim 1, wherein the lower articulation ring is non-relocatably connected to the mast, which is vertically adjustable.

10. The standing parasol according to claim 1, wherein the drive casing, the drive roll, the circulating member, a toothed plate, telescopic guides, the deflection support, the deflection roller bearing, the deflection roller and the telescopic tube constitute a distinct construction group, which can be introduced into the mast and can be attached to the mast by means of the drive casing.

* * * * *